US008227160B2

(12) United States Patent
Hidaka et al.

(10) Patent No.: US 8,227,160 B2
(45) Date of Patent: Jul. 24, 2012

(54) TONER FOR ELECTROPHOTOGRAPHY

(75) Inventors: Yasuhiro Hidaka, Wakayama (JP); Kouhei Katayama, Wakayama (JP); Yasuki Ohtawa, Wakayama (JP)

(73) Assignee: Kao Corporation, Tokyo (JP)

( * ) Notice: Subject to any disclaimer, the term of this patent is extended or adjusted under 35 U.S.C. 154(b) by 375 days.

(21) Appl. No.: 12/445,549

(22) PCT Filed: Oct. 16, 2007

(86) PCT No.: PCT/JP2007/070136

§ 371 (c)(1),
(2), (4) Date: Apr. 14, 2009

(87) PCT Pub. No.: WO2008/047775

PCT Pub. Date: Apr. 24, 2008

(65) Prior Publication Data

US 2010/0009279 A1 Jan. 14, 2010

(30) Foreign Application Priority Data

Oct. 16, 2006 (JP) ..... 2006-281990
Oct. 16, 2006 (JP) ..... 2006-281991
Oct. 16, 2006 (JP) ..... 2006-281993

(51) Int. Cl.
*G03G 9/00* (2006.01)

(52) U.S. Cl. ..... 430/108.23; 430/106.1; 430/108.3; 430/109.4

(58) Field of Classification Search ..... 430/108.1, 430/108.2, 108.23, 108.3, 108.4, 109.1, 109.4
See application file for complete search history.

(56) References Cited

U.S. PATENT DOCUMENTS

| | | | | |
|---|---|---|---|---|
| 4,623,606 | A * | 11/1986 | Ciccarelli | 430/108.21 |
| 5,529,871 | A | 6/1996 | Ichimura et al. | |
| 5,637,430 | A * | 6/1997 | Shimizu et al. | 430/108.23 |
| 5,728,501 | A | 3/1998 | Nakanishi et al. | |
| 2002/0051922 | A1* | 5/2002 | Yamazaki et al. | 430/106.2 |
| 2005/0095523 | A1* | 5/2005 | Shimokusa et al. | 430/108.8 |
| 2006/0046176 | A1* | 3/2006 | Hidaka | 430/108.8 |
| 2009/0280426 | A1* | 11/2009 | Kunii et al. | 430/108.23 |

FOREIGN PATENT DOCUMENTS

| | | |
|---|---|---|
| JP | 61155464 | 7/1986 |
| JP | 4242752 | 8/1992 |
| JP | 7-98519 | 4/1995 |
| JP | 7181734 | 7/1995 |
| JP | 8183841 | 7/1996 |
| JP | 9-204071 | 8/1997 |
| JP | 11-322915 | 11/1999 |
| JP | 2000-214638 | 8/2000 |
| JP | 2000-242030 | 9/2000 |
| JP | 2000-275908 | 10/2000 |
| JP | 2001 075312 | 3/2001 |
| JP | 2001-356522 | 12/2001 |
| JP | 2002-179604 | 6/2002 |
| JP | 2003-43741 | 2/2003 |
| JP | 2003 255604 | 9/2003 |
| JP | 2004-078206 | 3/2004 |
| JP | 2004 163836 | 6/2004 |
| JP | 2005 010454 | 1/2005 |
| JP | 2005-077721 | 3/2005 |
| JP | 2005-314686 | 11/2005 |
| JP | 2006 017954 | 1/2006 |
| JP | 2006 99098 | 4/2006 |
| JP | 2006-154399 | 6/2006 |
| JP | 2006-227241 | 8/2006 |
| JP | 2006-309214 | 11/2006 |
| JP | 2007-114398 | 5/2007 |
| JP | 2007-264623 | 10/2007 |
| JP | 2011-046919 | 3/2011 |
| JP | 2011-122073 | 6/2011 |

OTHER PUBLICATIONS

Office Action issued May 11, 2011 in China Application No. 200780038480.9 (With English Translation).

Office Action issued Oct. 10, 2011, in Chinese Patent Application No. 200780038480.9 with English translation.

"*positive*" entry in The American Heritage Dictionary of Science, Barnhart Books, reprint 1988, Boston MA, pp. 514-515.

Submission of Observations by Third Party in Japanese Application No. 2007-269129, with English Translation and JPO Notification issued Dec. 26, 2011.

Supplement to Observations by Third Party in Japanese Application No. 2007-269129, with English Translation (JPO Notification issued Dec. 26, 2011).

Submission of Observations by Third Party in Japanese Application No. 2007-269132, with English Translation and JPO Notification issued Dec. 26, 2011.

(Continued)

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

A toner for electrophotography comprising a charge control agent comprising a specified iron-azo complex or a specified metal compound of a benzilic acid derivative, a colorant, and a resin binder comprising a polyester, the polyester being a polyester obtained by polycondensing an alcohol component containing a propylene oxide adduct of bisphenol A and a carboxylic acid component, wherein the propylene oxide adduct of bisphenol A has an average mole of propylene oxide added of from 2.4 to 4.0, and wherein an adduct with 2 mol of propylene oxide is contained in an amount of 60% by mol or less, and an adduct with 4 mol of propylene oxide is contained in an amount of 10% by mol or more, of the propylene oxide adduct of bisphenol A, and wherein the propylene oxide adduct of bisphenol A has a content ratio of primary hydroxyl groups of 10% by mol or less of the entire hydroxyl groups. The toner for electrophotography of the present invention is suitably used in developing latent images and the like formed in electrophotography, electrostatic recording method, electrostatic printing method or the like.

10 Claims, No Drawings

OTHER PUBLICATIONS

Third Office Action issued Feb. 16, 2012, in Chinese Application No. 200780038480.9, with English Translation.
Excerpts of Nagasaki University Doctorate Thesis No. Haku-(Sei) Otsu No. 25, printed from http://hdl.handle.net/10069/22017 pp. 1-7, with English translation.
Office Action issued May 30, 2012, in Japanese Application No. 2007-269132 (w/English translation).
Office Action issued Jun. 4, 2012, in Japanese Application No. 2007-269129, (w/English translation).
Office Action issued Jun. 4, 2012, in Japanese Application No. 2007-269130 (w/English translation).
Vollhardt Schore Modern Organic Chemistry (vol. 1), Kagaku-Dojin Publshing Co., published Dec. 20, 2001, 3rd Ed. pp. 372-377 (w/English translation).

* cited by examiner

TONER FOR ELECTROPHOTOGRAPHY

TECHNICAL FIELD

The present invention relates to a toner for electrophotography usable in developing latent images formed in electrophotography, an electrostatic recording method, an electrostatic printing method, or the like.

BACKGROUND ART

In the field of electrophotography, toners that meet the requirements of high speed and high image quality are desired. In order to meet the requirements, a toner containing a polyol component, a part of which is a propylene oxide adduct of bisphenol A having a primary hydroxyl group is disclosed (see Patent Publication 1). In addition, a toner containing a specified charge control agent, for example, a toner containing an iron-based azo complex or a toner containing a metal-containing azo dye, is disclosed, from the viewpoint of increasing triboelectric stability of the toner (see Patent Publication 2).

Patent Publication 3 discloses a toner in which a masterbatch of colorants is used in order to improve color developability by increasing dispersibility of the colorants. Patent Publication 4 discloses a toner in which a polyester resin and a specified paraffinic wax are used from the viewpoint of improving fixing ability.

Patent Publication 1: JP-A-2006-17954
Patent Publication 2: JP-A-2001-75312
Patent Publication 3: JP-A-Hei-4-242752
Patent Publication 4: JP-A-2006-99098

SUMMARY OF THE INVENTION

The present invention relates to a toner for electrophotography containing a charge control agent containing an iron-azo complex represented by the formula (I):

[Ka 1]

(I)

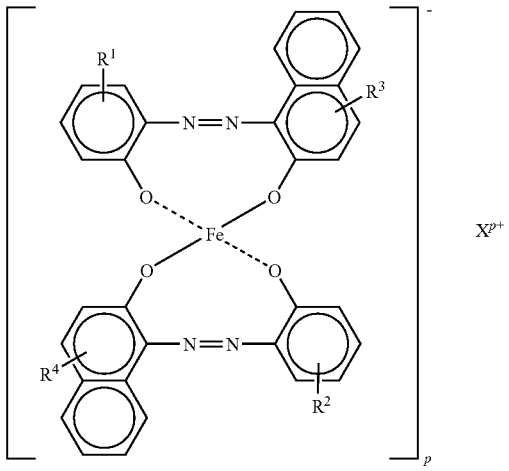

wherein each of $R^1$ and $R^2$ is independently a halogen atom or a nitro group, each of R3 and $R^4$ is independently a hydrogen atom, a halogen atom, an alkyl group having 1 to 3 carbon atoms, or a —CO—NH—($C_6H_5$) group, $X^{p+}$ is a cation, and p is an integer of 1 or 2, or a metal compound of a benzilic acid derivative represented by the formula (II):

[Ka 2]

(II)

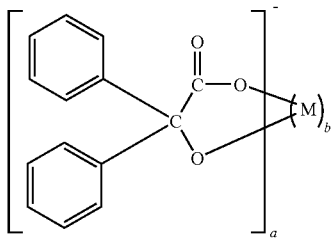

wherein M is boron or aluminum, a is an integer of 2 or more, and b is an integer of 1 or more;

a colorant; and a resin binder containing a polyester, the polyester being a polyester obtained by polycondensing an alcohol component containing a propylene oxide adduct of bisphenol A represented by the formula (III):

[Ka 3]

(III)

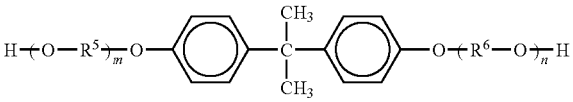

wherein each of $R^5$ and $R^6$ is independently —$CH(CH_3)CH_2$— and/or —$CH_2CH(CH_3)$—, and m number of $R^5$'s and n number of $R^6$'s may be identical or different, wherein m and n are positive numbers, and a carboxylic acid component, wherein the propylene oxide adduct of bisphenol A has an average mole of propylene oxide added of from 2.4 to 4.0, and wherein the adduct with 2 mol of propylene oxide is contained in an amount of 60% by mol or less, and the adduct with 4 mol of propylene oxide is contained in an amount of 10% by mol or more, of the propylene oxide adduct of bisphenol A, and wherein the propylene oxide adduct of bisphenol A has a content ratio of primary hydroxyl groups of 10% by mol or less of the entire hydroxyl groups.

DETAILED DESCRIPTION OF THE INVENTION

Toners containing large amounts of propylene oxide adducts of bisphenol A having a primary hydroxyl group have excellent fixing ability, but their durability is poor. Toners containing an iron-based azo complex have excellent triboelectric stability, but are likely to generate image deterioration due to lowering of the triboelectric charges in high-speed continuous printing. Even though toners in which a masterbatch is used have improved color developability, a resin having a high softening point or a high viscosity cannot be used, so that their durability is not sufficient. If a resin binder having a high softening point and a paraffinic wax having a low melting point are used, the resulting toner has excellent durability but insufficient low-temperature fixing ability. Therefore, there is a demand of satisfying both low-temperature fixing ability and durability.

The present invention relates to a toner for electrophotography that is capable of satisfying both low-temperature fixing ability and durability.

The toner for electrophotography of the present invention is excellent in both low-temperature fixing ability and durability, so that the toner exhibits excellent effects that images of excellent quality can be provided.

Low-temperature fixing ability of a toner is affected by the level of softening point of a resin binder. However, as a result of intensive studies, the present inventors have found that the fixing properties of resins greatly differ depending upon the monomer composition even at the same softening point. In other words, it has been found that low-temperature fixing ability is improved even at the same softening point level by using an alcohol component containing a specified propylene oxide adduct of bisphenol A in a particular amount.

Although the details of these phenomena are unknown, it is presumed that the movement of the main chain of the polymer in a temperature region of equal to or higher than a glass transition temperature becomes intensive by incorporating a flexible monomer, i.e. a propylene oxide adduct in which bisphenol A is added with 2 mol of propylene oxide, and a propylene oxide adduct in which bisphenol A is added with 4 mol of propylene oxide, into the main backbone portion of the resin, so that fixing ability at a low temperature is considered to improve. From the above viewpoint, an even greater effect is obtained in a case where the overall number of moles added is increased than a case where only an average mole added is adjusted by adding a small amount of an adduct with higher moles of propylene oxide. In addition, by using the polymer together with an iron-azo complex or a metal compound of a benzilic acid derivative, it is assumed that along with the increased movement of the main chain of the polymer, dispersibility of the iron-azo complex or the metal compound of a benzilic acid derivative is improved, so that the lowering of the triboelectric level accompanying high-speed continuous printing is suppressed, thereby securing durability. Further, since there is no limitation on the resin in the toner of the present invention that is posed in a case where a masterbatch of colorants is used, a resin having durability that is appropriate for high-speed continuous printing can be used.

The toner of the present invention contains a charge control agent containing an iron-azo complex or a metal compound of a benzilic acid derivative mentioned later, a colorant, and a resin binder containing a polyester obtainable by polycondensing an alcohol component containing a specified propylene oxide adduct of bisphenol A, as mentioned above, in a particular amount and a carboxylic acid component.

The propylene oxide adduct of bisphenol A contained in the alcohol component is represented by the formula (III):

[Ka 4]

(III)

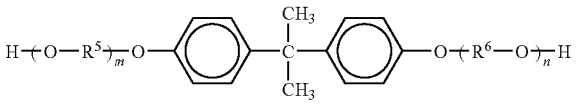

wherein each of $R^5$ and $R^6$ is independently —$CH(CH_3)CH_2$— and/or —$CH_2CH(CH_3)$—, and m number of $R^5$'s and n number of $R^6$'s may be identical or different, wherein m and n are positive numbers, and the sum of m and n is preferably from 1 to 18, more preferably from 1 to 16, and even more preferably from 1 to 14.

Here, the sum of m and n means the number of propylene oxide molecules added to one molecule of bisphenol A.

Among the propylene oxide adducts of bisphenol A represented by the formula (III), the propylene oxide adduct in which bisphenol A is added with 2 mol of propylene oxide is contained in an amount of 60% by mol or less, preferably from 10 to 55% by mol, more preferably from 20 to 50% by mol, and even more preferably from 25 to 50% by mol, of the alcohol component, from the viewpoint of low-temperature fixing ability. The content of the adduct per added number of moles of propylene oxide as used herein is calculated by a method described in Examples set forth below.

Similarly, among the propylene oxide adducts of bisphenol A represented by the formula (III), the propylene oxide adduct in which bisphenol A is added with 4 mol of propylene oxide is contained in an amount of 10% by mol or more, preferably from 10 to 30% by mol, more preferably from 10 to 25% by mol, and even more preferably from 15 to 25% by mol, of the alcohol component, from the viewpoint of storage stability of the toner.

The propylene oxide adduct of bisphenol A represented by the formula (III) besides those mentioned above includes an adduct with 1 mol of propylene oxide, an adduct with 3 mol of propylene oxide, an adduct with 5 mol of propylene oxide, and the like. These compounds may be contained within the range that would not impair the effects of the present invention, and the propylene oxide adduct in which bisphenol A is added with 5 mol of propylene oxide is contained in an amount of preferably from 1 to 10% by mol, and more preferably from 2 to 8% by mol, of the alcohol component, from the viewpoint of storage stability of the toner.

The propylene oxide adducts of bisphenol A represented by the formula (III) are contained in a total amount of preferably 30% by mol or more, more preferably from 50 to 100% by mol, and even more preferably from 70 to 100% by mol, of the alcohol component, from the viewpoint of storage property of the toner.

The propylene oxide adduct of bisphenol A represented by the formula (III) has an average number of moles added of from 2.4 to 4.0, preferably from 2.7 to 3.7, more preferably from 2.7 to 3.4, and even more preferably from 2.9 to 3.4, from the viewpoint of low-temperature fixing ability and image qualities such as the generation of streaks and background fogging. The average number of moles added as referred to herein means the average number of moles of propylene oxide added per one mol of bisphenol A.

In addition, the propylene oxide adduct of bisphenol A represented by the formula (III) has a content ratio of primary hydroxyl groups of 10% by mol or less, preferably from 2 to 8% by mol, and more preferably from 2 to 6% by mol, of the entire hydroxyl groups, from the viewpoint of image qualities such as the generation of streaks and background fogging. The content ratio of primary hydroxyl groups as used herein is calculated by a method described in Examples set forth below.

A method of preparing a propylene oxide adduct of bisphenol A represented by the formula (III) includes, for example, a method including the step of adding propylene oxide to bisphenol A in the presence of a catalyst, and the like. If necessary, after the addition reaction, the reaction mixture may be allowed to be matured for a certain period of time. In addition, the distribution of the number of moles of propylene oxide added in the resulting adduct is in many cases affected by an amount of a catalyst or an addition reaction temperature, and the distribution may be also affected by a maturation time period. For example, in a case where a catalyst is used in a large amount, in a case where an addition reaction temperature is high, in a case where a maturation time period is long, or the like, the distribution of the number of moles added in the propylene oxide adduct is likely to be broad.

Specifically, the average number of moles of propylene oxide added is 2.4 to 4.0. For example, a propylene oxide adduct of bisphenol A containing an adduct with 2 mol of propylene oxide in an amount of 60% by mol or less and an adduct with 4 mol of propylene oxide in an amount of 10% by mol or more, of the propylene oxide adduct of bisphenol A is obtained by reacting propylene oxide in an amount of from 2.4 to 4.0 mol per one mol of bisphenol A in the presence of a catalyst, and thereafter allowing the resulting reaction mixture to mature. The content of the adduct with 4 mol of propylene oxide can be adjusted by controlling the amount of a catalyst, the addition reaction temperature, and allowing the reaction mixture to mature after introduction of propylene oxide, and the content of the adduct with 2 mol of propylene oxide adduct can be adjusted, in addition to the adjustments by the above conditions, by washing with a water-soluble solvent to remove the adduct with higher mol of propylene oxide. In a case where the adduct with 4 mol of propylene oxide is in a small amount, the disproportionation reaction is caused by a method of increasing an amount of a catalyst, elevating an addition reaction temperature, extending a maturation time period after addition, or the like, whereby the amount of the adduct with 4 mol of propylene oxide can be increased. Taking into consideration the production efficiency, the residual alkali metal after the production, or the like, a method of adjustment by elevating an addition reaction temperature is preferred.

The catalyst includes basic catalysts such as potassium hydroxide and sodium hydroxide; acidic catalysts such as boron trifluoride and aluminum chloride; and the like. It is preferable to use a basic catalyst, from the viewpoint of reducing the content ratio of primary hydroxyl groups in the terminal hydroxyl groups in the propylene oxide adduct of bisphenol A, and the basic catalyst is preferably potassium hydroxide. In addition, the above-mentioned content ratio of primary hydroxyl groups can be adjusted by using an acidic catalyst together with the basic catalyst. For example, the content ratio of primary hydroxyl groups can be increased by performing the reaction in the presence of the acidic catalyst after the addition reaction in the presence of the basic catalyst. The catalyst is used in a total amount of preferably from 0.01 to 10 parts by weight, and more preferably from 0.1 to 5 parts by weight, based on 100 parts by weight of the bisphenol A.

The temperature for the addition reaction is preferably from 20° to 200° C., and more preferably from 100° to 140° C., from the viewpoint of reaction rate and quality. The pressure for the addition reaction is preferably from 0.005 to 0.9 MPa, and more preferably from 0.01 to 0.6 MPa.

The maturation time period after the addition is preferably from 0.1 to 10 hours, and more preferably from 0.5 to 5 hours.

The dihydric alcohol other than the propylene oxide adduct of bisphenol A represented by the formula (III) includes ethylene oxide adducts of bisphenol A, ethylene glycol, 1,2-propylene glycol, 1,4-butanediol, neopentyl glycol, polyethylene glycol, polypropylene glycol, hydrogenated bisphenol A, and the like.

The trihydric or higher polyhydric alcohol includes, for example, sorbitol, pentaerythritol, glycerol, trimethylolpropane, and the like.

On the other hand, in the carboxylic acid component, the dicarboxylic acid compound includes aromatic dicarboxylic acids, such as phthalic acid, isophthalic acid, and terephthalic acid; aliphatic dicarboxylic acids, such as oxalic acid, malonic acid, maleic acid, fumaric acid, citraconic acid, itaconic acid, glutaconic acid, succinic acid, adipic acid, and succinic acid substituted with an alkyl group having 1 to 20 carbon atoms or an alkenyl group having 2 to 20 carbon atoms, such as dodecenylsuccinic acid and octylsuccinic acid; acid anhydrides thereof, alkyl (1 to 3 carbon atoms) esters of these acids, and the like. Among them, the aromatic dicarboxylic acid compounds are preferred, terephthalic acid and isophthalic acid are more preferred, and terephthalic acid is even more preferred, from the viewpoint of triboelectric chargeability. The acids, anhydrides of these acids, and the alkyl esters of the acids as listed above are collectively referred to herein as a carboxylic acid compound.

The aromatic dicarboxylic acid compound is contained in an amount of preferably from 55 to 99% by mol, and more preferably from 70 to 90% by mol, of the carboxylic acid component.

The tricarboxylic or higher polycarboxylic acid compound includes, for example, 1,2,4-benzenetricarboxylic acid (trimellitic acid), 2,5,7-naphthalenetricarboxylic acid, pyromellitic acid, and acid anhydrides thereof, lower alkyl (1 to 3 carbon atoms) esters thereof, and the like.

The tricarboxylic or higher polycarboxylic acid compound is contained in an amount of preferably from 3 to 49% by mol, more preferably from 10 to 45% by mol, and even more preferably from 20 to 40% by mol, of the carboxylic acid component, from the viewpoint of pulverizability.

The trivalent or higher polyvalent raw material monomers (the trihydric or higher polyhydric alcohol and tricarboxylic or higher polycarboxylic acid compound) are contained in an amount of preferably from 1 to 25% by mol, more preferably from 3 to 23% by mol, and even more preferably from 7 to 21% by mol, of the entire raw material monomers.

Further, the alcohol component and the carboxylic acid component may properly contain a monohydric alcohol or a monocarboxylic acid compound, from the viewpoint of adjusting molecular weight, and the like.

The polyester can be produced by, for example, polycondensing an alcohol component and a carboxylic acid component in an inert gas atmosphere, using, if necessary, an esterification catalyst (for example, a metal compound such as a tin catalyst or a titanium catalyst), at a temperature of from 180° to 250° C.

As the tin catalyst, besides the tin compound having a Sn—C bond, such as dibutyltin oxide, a tin(II) compound without containing a Sn—C bond can be used. The tin(II) compound without containing a Sn—C bond includes, for example, tin(II) carboxylates having a carboxylate group having 2 to 28 carbon atoms, such as tin(II) oxalate, tin(II) acetate, tin(II) octanoate, tin(II) octylate (also referred to as tin(II) 2-ethylhexanoate), tin(II) laurate, tin(II) stearate, and tin(II) oleate; alkoxy tin(II) having an alkoxy group having 2 to 28 carbon atoms, such as octyloxy tin(II), lauroxy tin(II), stearoxy tin(II), and oleyloxy tin(II); tin(II) oxide; tin(II) sulfate; tin(II) halides, such as tin(II) chloride and tin(II) bromide, and the like. Among them, tin(II) octylate is preferred.

The amount of the esterification catalyst existing in the reaction system is preferably from 0.05 to 1 part by weight, and more preferably from 0.1 to 0.8 parts by weight, based on a total amount of 100 parts by weight of the alcohol component and the carboxylic acid component.

The polyester has a softening point of preferably from 70° to 140° C., preferably from 80° to 140° C., and more preferably from 85° to 135° C., from the viewpoint of fixing ability.

The polyester has a glass transition temperature of preferably from 45° to 70° C., more preferably from 47° to 65° C., and even more preferably from 50° to 65° C., from the viewpoint of fixing ability and storage property.

Further, the toner of the present invention may contain a composite resin of the above polyester and a vinyl resin as a resin binder.

In addition, the toner of the present invention may contain a resin binder other than the above polyester within the range that would not impair the effects of the present invention. The resin binder other than the above-mentioned polyester includes known resins usable in a toner, for example, styrene-acrylic resins, epoxy resins, polycarbonates, polyurethanes, and the like. A resin having a softening point of preferably from 90° to 170° C., more preferably from 95° to 155° C., and even more preferably from 100° to 145° C., and a glass transition temperature of preferably from 45° to 75° C., more preferably from 50° to 70° C., and even more preferably from 53° to 65° C., is desirable, from the viewpoint of securing a non-offset region. The amount of the polyester contained is not particularly limited, and the polyester is contained in an amount of preferably from 60 to 100% by weight, more preferably from 80 to 100% by weight, and even more preferably substantially 100% by weight, of the resin binder, from the viewpoint of low-temperature fixing ability.

The iron-azo complex in the present invention is a compound represented by the formula (I):

[Ka 5]

(I)

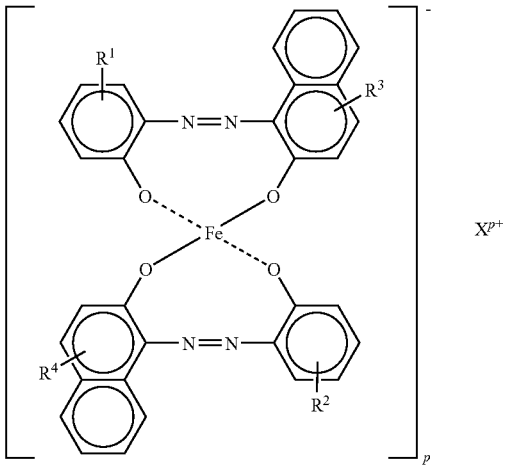

wherein each of $R^1$ and $R^2$ is independently a halogen atom or a nitro group, each of $R^3$ and $R^4$ is independently a hydrogen atom, a halogen atom, an alkyl group having 1 to 3 carbon atoms, or a —CO—NH—($C_6H_5$) group, $X^{p+}$ is a cation, and p is an integer of 1 or 2, from the viewpoint of image qualities such as the generation of streaks and background fogging.

In the present invention, among the iron-azo complexes represented by the formula (I), a metal complex compound in which each of $R^1$ and $R^2$ is a halogen atom, especially a chlorine atom, each of $R^3$ and $R^4$ is a —CO—NH—($C_6H_5$) group, and $X^{p+}$ is a hydrogen ion, sodium ion or ammonium ion is preferred.

Incidentally, as to the iron-azo complex represented by the formula (I), a production method thereof is described in detail in JP-A-Showa-61-155464, or the like, and the complex can be easily synthesized in accordance with the method. A commercially available product includes, for example "T-77" (manufactured by HODOGAYA CHEMICAL CO., LTD.).

In addition, the metal compound of a benzilic acid derivative in the present invention is a compound represented by the formula (II):

[Ka 6]

(II)

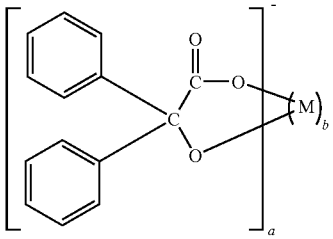

wherein M is boron or aluminum, a is an integer of 2 or more, and b is an integer of 1 or more, from the viewpoint of dispersibility of the colorant.

In the present invention, among the metal compounds of benzilic acid derivatives represented by the formula (II), a metal complex compound in which M is boron is preferred.

Commercially available products for the metal compound of a benzilic acid derivative include "LR-147" (M: boron, manufactured by Nippon Carlit), and the like.

The iron-azo complex represented by the formula (I) or the metal compound of a benzilic acid derivative represented by the formula (II) is contained in an amount of preferably from 0.1 to 5 parts by weight, more preferably from 0.3 to 3 parts by weight, and even more preferably from 0.5 to 2 parts by weight, based on 100 parts by weight of the resin binder, from the viewpoint of color developability and triboelectric chargeability of the toner.

Further, the toner of the present invention may contain a charge control agent other than the iron-azo complex represented by the formula (I) and the metal compound of a benzilic acid derivative represented by the formula (II), within the range so as not to impair the effects of the present invention. Other charge control agents include positively chargeable charge control agents, such as triphenylmethane-based dyes containing a tertiary amine as a side chain, quaternary ammonium salt compounds, polyamine resins, imidazole derivatives; and negatively chargeable charge control agents such as metal compounds of salicylic acid derivatives. In order to obtain high image quality which is a purpose of the present invention, the iron-azo complex represented by the formula (I) or the metal compound of a benzilic acid derivative represented by the formula (II) is contained in an amount of preferably 70% by weight or more, more preferably 80% by weight or more, even more preferably 90% by weight or more, and even more preferably substantially 100% by weight, of the charge control agent.

In the present invention, as the colorant, all of dyes, pigments, and the like which are used as colorants for a toner can be used, and carbon blacks, Phthalocyanine Blue, Permanent Brown FG, Brilliant Fast Scarlet, Pigment Green B, C. I. Pigment Blue 15:3, Rhodamine-B Base, Solvent Red 49, Solvent Red 146, Solvent Blue 35, quinacridone, Carmine 6B, Disazoyellow, and the like can be used. The toner of the present invention may be any of black toners and color toners. The colorant is contained in an amount of preferably from 1 to 40 parts by weight, and more preferably from 2 to 10 parts by weight, based on 100 parts by weight of the resin binder.

The toner of the present invention may appropriately further contain an additive such as a releasing agent, a magnetic powder, a fluidity improver, an electric conductivity modifier, an extender, a reinforcing filler such as a fibrous substance, an antioxidant, an anti-aging agent, or a cleanability improver.

The releasing agent is not particularly limited, and the releasing agent is desirably a wax having a melting point of preferably from 60° to 95° C., more preferably from 60° to 90° C., and even more preferably from 70° to 90° C., from the viewpoint of low-temperature fixing ability and durability of the toner under high-temperature, high-humidity conditions.

The kinds of the waxes usable in the present invention include paraffinic waxes, such as low-molecular weight polypropylenes, low-molecular weight polyethylenes, low-molecular weight polypropylene-polyethylene copolymers, microcrystalline waxes, paraffinic waxes, Fischer-Tropsch wax and oxides thereof; ester waxes such as carnauba wax, montan wax, sazole wax, and deacidified waxes thereof; fatty acid amides, fatty acids, higher alcohols, metal salts of fatty acids, and the like. Among them, the paraffinic waxes and the ester waxes are preferred, from the viewpoint of durability of the toner under high-temperature, high-humidity conditions, and the paraffinic waxes are more preferred, from the viewpoint of low-temperature fixing ability. The above-mentioned wax may be contained alone or in a mixture of two or more kinds. The wax is contained in an amount of preferably from 0.1 to 20 parts by weight, and more preferably from 0.5 to 10 parts by weight, based on 100 parts by weight of the resin binder.

The toner of the present invention may be a toner obtained by any of conventionally known methods such as a melt-kneading method, an emulsion phase-inversion method, and a polymerization method, and a pulverized toner produced by the melt-kneading method is preferable, from the viewpoint of productivity and dispersibility of a colorant. Incidentally, in the case of a pulverized toner produced by the melt-kneading method, a toner can be produced by mixing raw materials of the resin binder, the colorant, the iron-azo complex or the metal compound of a benzilic acid derivative, and the like homogeneously with a mixer such as a Henschel mixer, thereafter melt-kneading the mixture with a closed kneader, a single-screw or twin-screw extruder, an open roller-type kneader, or the like, cooling, pulverizing, and classifying the product. The toner has a volume-median particle size ($D_{50}$) of preferably from 2 to 15 μm, and more preferably from 3 to 10 μm. The term "volume-median particle size ($D_{50}$)" as used herein means a particle size at 50% when calculated from particle sizes of smaller particle sizes in the cumulative volume frequency calculated in percentage on the volume basis.

The toner of the present invention can be used as a toner for monocomponent development, or as a two component developer prepared by mixing the toner with a carrier.

EXAMPLES

[Softening Point of Resin]

The softening point refers to a temperature at which a half of the sample flows out, when plotting a downward movement of a plunger of a flow tester (Shimadzu Corporation, "CFT-500D"), against temperature, in which a sample is prepared by applying a load of 1.96 MPa thereto with the plunger using the flow tester and extruding a 1 g sample through a nozzle having a die pore size of 1 mm and a length of 1 mm, while heating the sample so as to raise the temperature at a rate of 6° C./min.

[Glass Transition Temperature of Resin]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter ("DSC 210," manufactured by Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Value of Resin]

The acid value is measured based on a method of JIS K0070, provided that only a measurement solvent is changed from a mixed solvent of ethanol and ether as prescribed in JIS K0070 to a mixed solvent of acetone and toluene (acetone: toluene=1:1 (volume ratio)).

[Volume-Median Particle Size (D50) of Toner]

Measuring Apparatus: Coulter Multisizer II (manufactured by Beckman Coulter)

Aperture Diameter: 50 μm

Analyzing Software: Coulter Multisizer AccuComp Ver. 1.19 (manufactured by Beckman Coulter)

Electrolytic Solution: Isotone II (manufactured by Beckman Coulter)

Dispersion: EMULGEN 109P (manufactured by Kao Corporation, polyoxyethylene lauryl ether, HLB: 13.6) is dissolved in the above-mentioned electrolytic solution so as to have a concentration of 5% by weight to give a dispersion.

Dispersion Conditions: Ten milligrams of a measurement sample is added to 5 mL of the above-mentioned dispersion, the mixture is dispersed for 1 minute with an ultrasonic disperser, and 25 mL of an electrolytic solution is added to the dispersion, and further dispersed with an ultrasonic disperser for 1 minute, to prepare a sample dispersion.

Measurement Conditions: The above-mentioned sample dispersion is added to 100 mL of the above-mentioned electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

[Content Ratio of Primary Hydroxyl Groups in Propylene Oxide Adduct]

The content ratio of primary hydroxyl groups is measured according to a $^1$H-NMR method.

(1) Method of Preparing Sample (Pretreatment)

About 30 mg of a sample to be measured is weighed in a sample tube for NMR having a diameter of 5 mm, and about 0.5 mL of a deuterated solvent is added thereto to allow the sample to dissolve. Thereafter, about 0.1 mL of trifluoroacetic anhydride is added to the solution, to provide a sample for analysis. The above-mentioned deuterated solvent is, for example, deuterated chloroform, deuterated toluene, deuterated dimethyl sulfoxide, deuterated dimethylformamide, or the like, and a solvent capable of dissolving the sample is properly selected.

(2) NMR Measurement

The $^1$H-NMR measurement is performed under ordinary conditions.

(3) Calculation Method for Content Ratio of Primary Hydroxyl Groups

By the method of the pretreatment mentioned above, a hydroxyl group at a terminal of the propylene oxide adduct of bisphenol A is reacted with the added trifluoroacetic anhydride to form a trifluoroacetic acid ester. As a result, a signal ascribed to a methylene group bound to the primary hydroxyl group is observed in the neighborhood of 4.3 ppm, and a signal ascribed to a methine group bound to the secondary hydroxyl group is observed in the neighborhood of 5.2 ppm. The content ratio of primary hydroxyl groups is calculated according to the following calculation formula.

Content Ratio of Primary Hydroxyl Groups (%)= $[a/(a+2\times b)]\times 100$ wherein a is an integral value at a signal ascribed to a methylene group bound to the primary hydroxyl group that is observed in the neighborhood of 4.3 ppm; and b is an integral value at a signal ascribed to a methine group bound to the secondary hydroxyl group that is observed in the neighborhood of 5.2 ppm.

[Content of Adduct Per Each Added Number of Moles in Propylene Oxide Adduct]

The content of the adduct is measured according to the following method using GC (gas chromatography).

(1) Pretreatment (Silylation of Sample)

A 40 to 60 mg sample is taken into 5 mL of a specimen vial tube, and 1 mL of a silylation agent (TH, manufactured by KANTO CHEMICAL CO., INC.) is added thereto. The sample is then dissolved by a hot water bath (50° to 80° C.), and the solution is shaken to carry out silylation. After allowing the reaction mixture to stand, the separated supernatant is used as a sample to be measured.

(2) Measurement Apparatus

GC: GC14B (manufactured by Shimadzu Corporation)

(3) Measurement Conditions

Analyzing Column: Filler: SILICON OV-17(product having a size of 60/80 mesh) manufactured by GL Science; length 1 m×diameter 2.6 mm Carrier: He Flow Rate Conditions: 1 mL/min Injection Inlet Temperature: 300° C.

Oven Temperature Conditions

Initiating Temperature: 100° C.

Rate of Temperature Rise: 8° C./min

Termination Temperature: 300° C.

Retention Time: 25 min (4) Quantification of Adduct

A weight ratio is obtained from a peak area corresponding each component detected according to gas chromatography, and a molar ratio is obtained by converting the weight ratio to molecular weights.

[Melting Point of Wax]

The melting point refers to a maximum peak temperature of heat of fusion, which is determined using a differential scanning calorimeter ("DSC 210," manufactured by Seiko Instruments, Inc.), by raising its temperature to 200° C., cooling the sample from this temperature to 0° C. at a cooling rate of 10° C./min, and thereafter raising the temperature of the sample at a heating rate of 10° C./min.

Production Example 1 of Propylene Oxide Adduct

An autoclave equipped with a stirrer and a temperature-controlling function was charged with 228 g (1 mol) of bisphenol A and 2 g of potassium hydroxide. Thereinto was introduced 174 g (3 mol) of propylene oxide at 135° C. under a pressure within the range of from 0.1 to 0.4 MPa, and the mixture was then subjected to addition reaction for 3 hours. Sixteen grams of an adsorbent "KYOWAAD 600" (manufactured by Kyowa Chemical Industry Co., Ltd.: $2MgO.6SiO_2.XH_2O$) was supplied to a reaction product, and the reaction mixture was stirred at 90° C. for 30 minutes to mature the reaction mixture. Subsequently, the mixture was filtered, to provide a propylene oxide adduct A of bisphenol A.

Production Example 2 of Propylene Oxide Adduct

An autoclave equipped with a stirrer and a temperature-controlling function was charged with 228 g (1 mol) of bisphenol A and 2 g of potassium hydroxide. Thereinto was introduced 139 g (2.2 mol) of propylene oxide at 135° C. under a pressure within the range of from 0.1 to 0.4 MPa, and the mixture was then subjected to addition reaction for 3 hours. Sixteen grams of an adsorbent "KYOWAAD 600" (manufactured by Kyowa Chemical Industry Co., Ltd.: $2MgO.6SiO_2.XH_2O$) was supplied to a reaction product, and the reaction mixture was stirred at 90° C. for 30 minutes to mature the reaction mixture. Subsequently, the mixture was filtered, to provide a propylene oxide adduct B of bisphenol A.

Production Example 3 of Propylene Oxide Adduct

An autoclave equipped with a stirrer and a temperature-controlling function was charged with 3380 g (9.7 mol) of the compound B obtained in Production Example 2 mentioned above and 0.78 g (0.157 mmol) of tris(pentafluorophenyl) borane. Thereinto was introduced 619 g (10.7 mol) of propylene oxide at 75° C. under a pressure within the range of from 0.011 to 0.083 MPa over a period of 12 hours, and the mixture was then subjected to addition reaction at 75° C. for 6 hours. To a reaction product were added 8.6 g of an adsorbent "KYOWAAD 1000" (manufactured by Kyowa Chemical Industry Co., Ltd.: $Mg_{4.5}Al_2(OH)_{13}CO_3.3.5\ H_2O$) and 68 g of ion-exchanged water, and the reaction mixture was stirred at 65° C. for 2 hours to mature the reaction mixture. Thereafter, the temperature was raised to 70° C., and water was distilled off under a pressure of 0.4 kPa. Subsequently, the mixture was filtered, to provide a propylene oxide adduct C of bisphenol A.

Production Example 1 of Resin

A 5-liter four-neck flask equipped with a nitrogen inlet tube, a dehydration tube, a stirrer, and a thermocouple was charged with raw material monomers and tin(II) octylate listed in Table 1. The ingredients in the flask were reacted at 230° C. under nitrogen atmosphere, until the conversion rate reached 90%, and the reaction mixture was further reacted at 8.3 kPa until the desired softening point was attained, to provide each of resins A, B, C, and D. The conversion rate as used herein means a value defined by a value calculated by: [amount of generated water in reaction (mol)/theoretical amount of generated water]×100.

TABLE 1

| | Resin A | Resin B | Resin C | Resin D |
|---|---|---|---|---|
| Resin Components<br>Raw Material Monomers | | | | |
| BPA-PO[1)] Adduct A | 3636 g (100) | — | — | — |
| BPA-PO Adduct B | — | 3500 g (100) | 3500 g (100) | — |
| BPA-PO Adduct C | — | — | — | 3500 g (100) |

TABLE 1-continued

| | Resin A | Resin B | Resin C | Resin D |
|---|---|---|---|---|
| Terephthalic Acid | 822 g (55) | 913 g (55) | — | 913 g (55) |
| Fumaric Acid | — | — | 1195 g (103) | — |
| Trimellitic Anhydride | 519 g (30) | 576 g (30) | — | 576 g (30) |
| Tin(II) Octylate | 15.0 g | 20.0 g | 15.0 g | 20.0 g |
| Physical Properties of BPA-PO | | | | |
| Average Number of Moles | 3.0 | 2.1 | 2.1 | 3.0 |
| Content Ratio (% by mol) of Primary Hydroxyl Groups | 4 | 14 | 14 | 30 |
| Content (% by mol) of Adduct with 2 mol of Propylene Oxide | 32.14 | 89.99 | 89.99 | 38.01 |
| Content (% by mol) of Adduct with 4 mol of Propylene Oxide | 20.47 | 0.64 | 0.64 | 18.57 |
| Content (% by mol) of Adduct with 5 mol of Propylene Oxide | 4.39 | 0 | 0 | 8.99 |
| Physical Properties of Resin | | | | |
| Softening Point (° C.) | 127 | 128 | 100 | 127 |
| Glass Transition Temperature (° C.) | 56 | 75 | 60 | 52 |
| Acid Value (mgKOH/g) | 21.4 | 33.1 | 20.2 | 23.1 |

Note)
Numerical figures inside the parentheses for the raw material monomers for resins are expressed by a molar ratio when a total amount of the alcohol component is calculated as 100 mol.
[1)]Polyoxypropylene-2,2-bis(4-hydroxyphenyl)propane Production Example 1 of Masterbatch of A Colorant The amount 3.75 kg of a water-containing paste (water content: 60%) of copper phthalocyanine (C.I. Pigment Blue 15:3) and 3.4 kg of the resin C were kneaded for 10 minutes with a pressure kneader under a pressure of 4 kg/m$^2$ after raising the temperature from 500 to 105° C., to provide MB-1 having a pigment content of 30%.

Examples 1-1 to 3-7 and Comparative Examples 1-1 to 3-4

A resin binder, a charge control agent, a colorant, and a wax listed in Table 2, 3, or 4 were previously mixed with a Henschel mixer, and then melt-kneaded with a twin screw extruder. The melt-kneaded mixture was pulverized and classified using a jet pulverizer and a dispersion separator, to give each of untreated toners.

An external additive in an amount as listed in Table 2, 3, or 4 was added to 100 parts by weight of the resulting untreated toner, and the mixture was mixed with a Henschel mixer, thereby providing toners of Examples 1-1, 2-1 and -2, and 3-1 to -7 and Comparative Examples 1-1 to -3, 2-1 to -3, and 3-1 to -4.

Here, the external additives used in Tables 2 to 4 are as follows.

Si-1: RY-50 (hydrophobic silica), manufactured by Nihon Aerosil Co., Ltd., average particle size: 40 nm, hydrophobic treatment agent:

dimethyl siloxane, BET specific surface area before the hydrophobic treatment: 50 m$^2$/g Si-2: H30TD (hydrophobic silica), manufactured by Wacker, average particle size: 8 nm, hydrophobic treatment agent: dimethyl siloxane, BET specific surface area before the hydrophobic treatment:
300 m$^2$/g Test Example 1 [Low-Temperature Fixing Ability]

A toner listed in Table 2, 3, or 4 was loaded on "Microline 5400" (manufactured by Oki Data Corporation), and unfixed images having a solid image portion of 2 cm×3 cm (amount of toner adhesion: 1.1 mg/cm$^2$) were obtained. The obtained unfixed images were allowed to fix while sequentially raising a fixing temperature from 130° to 200° C. with an increment of 10° C. using an external fixing apparatus (fixing speed: 300 mm/s) of "Microline 3050" (manufactured by Oki Data Corporation).

"Scotch (registered trademark) Mending Tape 810" (manufactured by SUMITOMO 3M LIMITED, width: 18 mm) was adhered to the fixed images. After the fixed images were rubbed over with a 1.25 kg weight, the tape was removed. The image densities before adhesion and after removal of the tape were measured with an image densitometer "GRETAG SPM50" (manufactured by Gretag). The low-temperature fixing ability was evaluated in accordance with the following evaluation criteria, where a fixing temperature at which a ratio between the two, after removal/before adhesion, initially exceeds 80% is defined as a lowest fixing temperature. The results are shown in Tables 2 to 4. Here, the paper sheets used in the fixing test are L sheets manufactured by XEROX.

[Evaluation Criteria for Low-Temperature Fixing Ability]

A: The lowest fixing temperature is lower than 150° C.

B: The lowest fixing temperature is 150° C. or higher and lower than 170° C.

C: The lowest fixing temperature is 170° C. or higher and lower than 180° C.

D: The lowest fixing temperature is 180° C. or higher.

Test Example 2 [Generation of Streaks (Durability)]

A toner listed in Table 2, 3, or 4 was loaded while adjusting a printing speed of a commercially available printer "Microline 5400" (manufactured by Oki Data Corporation). When A4 paper sheets (210 mm×297 mm) were subjected to continuous printing of up to 15,000 sheets with a character image having a printing ratio of 2% at a printing speed of 30 sheets/minute, the state of the generation of streaks on a developer roller surface was visually observed every 1,000 printed sheets, and generation of streaks (durability) was evaluated in accordance with the following evaluation criteria. The results are shown in Tables 2 to 4.

[Evaluation Criteria for Generation of Streaks (Durability)]

A: Streaks are not generated on a developer roller up to 15,000 printed sheets.

B: Streaks are generated on a developer roller after 10,000 printed sheets but before 15,000 printed sheet.

C: Streaks are generated on a developer roller before 10,000 printed sheets.

Test Example 3 [Background Fogging (Durability)]

A toner of Table 2 was loaded using the same printer as in Test Example 2. When the paper sheets were subjected to continuous printing of up to 15,000 sheets in the same manner, residual toners on a photoconductive drum surface were transferred to the mending tape every 1,000 printed sheets. The color densities of the tape before the adhesion and after the adhesion of the toner were measured with an image densitometer "GRETAG SPM50" (manufactured by Gretag). The background fogging (durability) was evaluated in accordance with the following criteria, judging that background fogging is generated in a case where a ratio of the two, after the adhesion/before the adhesion, is 0.11 or more. The results are shown in Table 2.

[Evaluation Criteria for Background Fogging (Durability)]

A: Background fogging is not generated up to 15,000 printed sheets.

B: Background fogging is generated on or after 12,000 printed sheets but on or before 15,000 printed sheets.

C: Background fogging is generated before 12,000 printed sheets.

Test Example 4 [Color Developability]

A toner listed in Table 3 was loaded on "Microline 5400" (manufactured by Oki Data Corporation), and unfixed images having a solid image portion of 2 cm×3 cm (amount of toner adhesion: 0.8 mg/cm$^2$) were obtained. The obtained unfixed images were allowed to fix by setting a fixing temperature to 180° C. using an external fixing apparatus (fixing speed: 300 mm/s) of "Microline 3050" (manufactured by Oki Data Corporation). The image densities of the fixed images were determined with an image densitometer "GRETAG SPM50" (manufactured by Gretag). The color developability was evaluated in accordance with the following evaluation criteria. The results are shown in Table 3. Here, the paper sheets used in the fixing test are L sheets manufactured by XEROX.

[Evaluation Criteria for Color Developability]

A: Image density is 1.2 or more.

B: Image density is 1.1 or more and less than 1.2.

C: Image density is less than 1.1.

Test Example 5 [Durability under High-Temperature, High-Humidity Environment]

A toner of Table 4 was loaded while adjusting a printing speed of a commercially available printer "Microline 5400" (manufactured by Oki Data Corporation) under environmental conditions of a temperature of 32° C. and humidity of 80%. When A4 size sheets (210 mm×297 mm) were subjected to continuous printing of up to 15,000 sheets with a character image having a printing ratio of 2% at a printing speed of 30 sheets/minute, the state of streaks generated on a developer roller surface was visually observed every 1,000 printed sheets. The durability under high-temperature, high-humidity conditions was evaluated in accordance with the following evaluation criteria. The results are shown in Table 4.

[Evaluation Criteria for Durability under High-Temperature, High-Humidity Conditions]

A: Streaks are not generated on a developer roller up to 15,000 printed sheets.

B: Streaks are generated on a developer roller on or after 10,000 printed sheets and before 15,000 printed sheets.

C: Streaks are generated on a developer roller before 10,000 printed sheets.

TABLE 2

| | Composition of Toner | | | | | | | Toner Before Treatment with External Additive | | Properties of Toner | | |
|---|---|---|---|---|---|---|---|---|---|---|---|---|
| | Resin Binder (Parts by Weight) | Charge Control Agent (Parts by Weight) | Colorant (Parts by Weight) | Wax (Parts by Weight) | Wax Melting Point (° C.) | External Additive (Parts by Weight) | | $D_{50}$[1] (μm) | <5.0 μm[2] (%) | Low-Temperature Fixing Ability | Generation of Lines (Durability) | Backround Fogging (Durability) |
| Ex. 1-1 | Resin A (92) | T-77 (1.0) | Mogul-L (5.0) | SP-105 (1.0) | 105 | Si-1 (1.2) | Si-2 (0.8) | 8.0 | 3.5 | A | A | A |
| Comp. Ex. 1-1 | Resin A (92) | T-77 (1.0) | Mogul-L (5.0) | SP-105 (1.0) | 105 | Si-1 (1.2) | Si-2 (0.8) | 7.9 | 3.8 | D | C | C |
| Comp. Ex. 1-2 | Resin A (92) | T-77 (1.0) | Mogul-L (5.0) | SP-105 (1.0) | 105 | Si-1 (1.2) | Si-2 (0.8) | 8.0 | 3.6 | B | C | C |
| Comp. Ex. 1-3 | Resin A (92) | T-77 (1.0) | Mogul-L (5.0) | SP-105 (1.0) | 105 | Si-1 (1.2) | Si-2 (0.8) | 8.1 | 3.5 | A | C | C |

Note)

Charge control agent:

"T-77" . . . Iron-Azo Complex (manufactured by Hodogaya Chemical Co., Ltd.)

"S-34" . . . Chromium-Azo Complex of Benzilic Acid (manufactured by Orient Chemical Co., Ltd.)

Colorant:

"Mogul-L" . . . Carbon Black (manufactured by Cabot Corporation),

Wax:

"SP-105" . . . Fischer-Topsch wax (manufactured by Sazole)

[1]Showing volume-median particle size ($D_{50}$)

[2]Showing content of particles having particle sizes of 5.0 μm or less in the volume particle size distribution.

TABLE 3

| | Composition of Toner | | | | | | | Toner Before Treatment with External Additive | | Properties of Toner | | |
|---|---|---|---|---|---|---|---|---|---|---|---|---|
| | Resin Binder (Parts by Weight) | Charge Control Agent (Parts by Weight) | Colorant (Parts by Weight) | Wax (Parts by Weight) | Wax Melting Point (° C.) | External Additive (Parts by Weight) | | $D_{50}$[1] (μm) | <5.0 μm[2] (%) | Low-Temperature Fixing Ability | Generation of Streaks (Durability) | Color Developability |
| Ex. 2-1 | Resin A (95) | LR-147 (1.0) | ECB-301 (3.0) | SP-105 (1.0) | 105 | Si-1 (1.2) | Si-2 (0.8) | 7.8 | 4.5 | A | A | A |
| Ex. 2-2 | Resin A (88) | LR-147 (1.0) | MB-1 (10.0) | SP-105 (1.0) | 105 | Si-1 (1.2) | Si-2 (0.8) | 8.0 | 4.4 | A | B | A |
| Comp. Ex. 2-1 | Resin B (95) | LR-147 (1.0) | ECB-301 (3.0) | SP-105 (1.0) | 105 | Si-1 (1.2) | Si-2 (0.8) | 7.7 | 4.8 | D | C | C |
| Comp. Ex. 2-2 | Resin A (95) | E-81 (1.0) | ECB-301 (3.0) | SP-105 (1.0) | 105 | Si-1 (1.2) | Si-2 (0.8) | 7.9 | 4.1 | B | C | C |
| Comp. Ex. 2-3 | Resin D (95) | LR-147 (1.0) | ECB-301 (3.0) | SP-105 (1.0) | 105 | Si-1 (1.2) | Si-2 (0.8) | 8.0 | 4.3 | A | C | A |

Note)
Charge Control Agent:
"LR-147". . . Boron Complex of Benzilic Acid (manufactured by Nippon Carlit Co., Ltd.)
"E-81". . . Chromium Complex of di-t-Butyl Salicylate (manufactured by Orient Chemical Co., Ltd.)
Colorant:
"ECB-301" . . . C.I. Pigment Blue 15:3 (manufactured by DAINICHISEIKA COLOR & CHEMICALS MFG. CO., LTD.)
"MB-1". . . Masterbatch of A Colorant
Wax:
"SP-105" . . . Fischer-Tropsch wax (manufactured by Sazole)
[1]Showing volume-median particle size ($D_{50}$)
[2]Showing content of particles having particle sizes of 5.0 μm or less in the volume particle size distribution.

TABLE 4

| | Composition of Toner | | | | | | | Toner Before Treatment with External Additive | | Properties of Toner | | |
|---|---|---|---|---|---|---|---|---|---|---|---|---|
| | Resin Binder (Parts by Weight) | Charge Control Agent (Parts by Weight) | Colorant (Parts by Weight) | Wax (Parts by Weight) | Wax Melting Point (° C.) | External Additive (Parts by Weight) | | $D_{50}$[1] (μm) | <5.0 μm[2] (%) | Low-Temperature Fixing Ability | Generation of Streaks (Durability) | Durability Under High-Temp., High-Humidity Conditions |
| Ex. 3-1 | Resin A (91) | T-77 (1.0) | Mogul-L (5.0) | HNP-9 (3.0) | 80 | Si-1 (1.2) | Si-2 (0.8) | 8.1 | 3.8 | A | A | A |
| Ex. 3-2 | Resin A (93) | LR-147 (1.0) | ECB-301 (5.0) | HNP-9 (3.0) | 80 | Si-1 (1.2) | Si-2 (0.8) | 8.0 | 4.1 | A | A | A |
| Ex. 3-3 | Resin A (91) | T-77 (1.0) | Mogul-L (5.0) | WAX-C1 (3.0) | 88 | Si-1 (1.2) | Si-2 (0.8) | 8.0 | 4.3 | B | A | A |
| Ex. 3-4 | Resin A (93) | LR-147 (1.0) | ECB-301 (5.0) | WAX-C1 (3.0) | 88 | Si-1 (1.2) | Si-2 (0.8) | 7.8 | 4.5 | B | A | A |
| Ex. 3-5 | Resin A (91) | T-77 (1.0) | Mogul-L (5.0) | PW655 (3.0) | 101 | Si-1 (1.2) | Si-2 (0.8) | 8.2 | 4.9 | B | A | C |
| Ex. 3-6 | Resin A (91) | T-77 (1.0) | Mogul-L (5.0) | NP-056 (3.0) | 127 | Si-1 (1.2) | Si-2 (0.8) | 8.0 | 4.6 | C | A | B |
| Ex. 3-7 | Resin A (93) | LR-147 (1.0) | ECB-301 (5.0) | PW655 (3.0) | 101 | Si-1 (1.2) | Si-2 (0.8) | 8.1 | 4.4 | B | A | C |
| Comp. Ex. 3-1 | Resin B (91) | T-77 (1.0) | Mogul-L (5.0) | HNP-9 (3.0) | 80 | Si-1 (1.2) | Si-2 (0.8) | 7.9 | 4.1 | D | A | B |
| Comp. Ex. 3-2 | Resin B (93) | LR-147 (1.0) | ECB-301 (5.0) | HNP-9 (3.0) | 80 | Si-1 (1.2) | Si-2 (0.8) | 8.1 | 4.3 | D | A | B |
| Comp. Ex. 3-3 | Resin D (93) | T-77 (1.0) | Mogul-L (5.0) | HNP-9 (3.0) | 80 | Si-1 (1.2) | Si-2 (0.8) | 8.0 | 4.1 | A | C | C |

TABLE 4-continued

| | Composition of Toner | | | | | | | Toner Before Treatment with External Additive | | Properties of Toner | | |
|---|---|---|---|---|---|---|---|---|---|---|---|---|
| | Resin Binder (Parts by Weight) | Charge Control Agent (Parts by Weight) | Colorant (Parts by Weight) | Wax (Parts by Weight) | Wax Melting Point (° C.) | External Additive (Parts by Weight) | | $D_{50}$[1] (μm) | <5.0 μm[2] (%) | Low-Temperature Fixing Ability | Generation of Streaks (Durability) | Durability Under High-Temp., High-Humidity Conditions |
| Comp. Ex. 3-4 | Resin D (93) | LR-147 (1.0) | ECB-301 (5.0) | HNP-9 (3.0) | 80 | Si-1 (1.2) | Si-2 (0.8) | 8.2 | 3.9 | A | C | C |

Note)

Charge control agent:

"T-77" . . . Iron-Azo Complex (manufactured by Hodogaya Chemical Co., Ltd.)

"LR-147" . . . Boron Complex of Benzilic Acid (manufactured by Nippon Carlit Co., Ltd.)

Colorant:

"Mogul-L" . . . Carbon Black (manufactured by Cabot Corporation),

"ECB-301" . . . C.I. Pigment Blue 15:3 (manufactured by DAINICHISEIKA COLOR & CHEMICALS MFG. CO., LTD.)

Wax:

"HNP-9" . . . Paraffinic wax (manufactured by Nippon Seiro);

"WAX-C1" . . . Carnauba WaxC1 (carnauba wax, manufactured by Kato Yoko);

"PW655" . . . POLYWAX 655 (polyethylene wax, manufactured by Toyo Petrolite);

"NP-056" . . . Polypropylene wax(manufactured by Mitsui Petrochemical)

[1]Showing volume-median particle size ($D_{50}$)

[2]Showing content of particles having particle sizes of 5.0 μm or less in the volume particle size distribution.

It can be seen from Table 2 that when compared with Comparative Examples 1-1 to 1-3, the toner of Example 1-1 has excellent low-temperature fixing ability and does not generate streaks or background fogging, so that excellent fixed images are obtained. The toner of Comparative Example 1-1 in which a resin B, which is a propylene oxide adduct of bisphenol A having an average number of moles added of 2.1, is used, has poorer low-temperature fixing ability, so that the toner generates streaks and background fogging. The toner of Comparative Example 1-2, in which the resin binder used is the same resin A as that of Example 1-1 but the charge control agent is not an iron-azo complex, is not so poor in low-temperature fixing ability, but generates streaks and background fogging, so that the toner is worse than those of Examples. The toner of Comparative Example 1-3 in which a resin D of which bisphenol A has a content ratio of primary hydroxyl groups of 30% by mol is used, is not so poor in low-temperature fixing ability, but generates streaks and background fogging. In addition, it can be seen from Table 3 that when compared with Comparative Examples 2-1 to 2-3, the toner of Example 2-1 has excellent low-temperature fixing ability and does not generate streaks, so that fixed images having excellent color developability are obtained. The toner of Comparative Example 2-1 in which a resin B, which is a propylene oxide adduct of bisphenol A having an average number of moles added of 2.1, is used, has poorer low-temperature fixing ability, and generates streaks, so that the toner has poor color developability. The toner of Comparative Example 2-2, in which the resin binder and the colorant are the same ones as those used in Example 2-1 but the charge control agent is not a metal compound of a benzilic acid derivative, is only somewhat poorer in low-temperature fixing ability, but generates streaks, so that developability is poor. In addition, a resin used in the masterbatch is limited, and the toner of Example 2-2 uses a masterbatch of a colorant, streaks are slightly generated during the durability printing, but is usable. From the above results, it can be seen that the desired effects are obtained by using a propylene oxide adduct of bisphenol A having the number of moles added in a given range, and using an iron-azo complex or a metal compound of a benzilic acid derivative as a charge control agent. The toner of Comparative Example 2-3 in which a resin D, of which bisphenol A has a content ratio of primary hydroxyl groups of 30% by mol, is used, is not so poor in low-temperature fixing ability and developability, but generates streaks.

In addition, it can be seen from Table 4 that as compared to Comparative Examples 3-1 to 3-4, the toners of Examples 3-1 to 3-7 have excellent low-temperature fixing ability and slightly generate streaks, so that the toners meet the requirements for both low-temperature fixing ability and durability. Among them, it can be seen that because the toners of Examples 3-1 and 3-2 use a wax having a melting point of 80° C. and the toners of Examples 3-3 and 3-4 use a wax having a melting point of 88° C., the toners are also excellent in durability under high-temperature, high-humidity conditions. It can be seen from the above that in a case of a toner using a resin made of propylene oxide of bisphenol A having an average number of moles added and a content ratio of primary hydroxyl groups within given ranges, and an iron-azo complex or a metal compound of a benzilic acid derivative, and further using a wax having a melting point of a specified range, the resulting toners not only meet the requirements for both low-temperature fixing ability and durability, but also have excellent durability under high-temperature, high-humidity conditions.

The toner for electrophotography of the present invention is suitably used in developing latent images and the like, formed in electrophotography, electrostatic recording method, electrostatic printing method or the like.

The invention claimed is:

1. A toner for electrophotography comprising a charge control agent comprising an iron-azo complex represented by the formula (I):

[Ka 1]

(I)

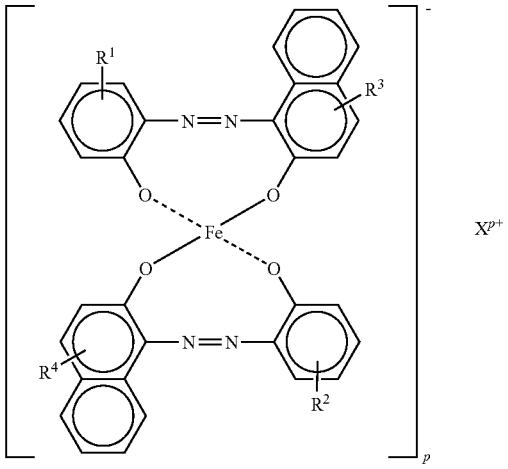

wherein each of $R^1$ and $R^2$ is a halogen atom, each of $R^3$ and $R^4$ is a —CO—NH—($C_6H_5$) group, $X^{p+}$ is a hydrogen ion, sodium ion, or ammonium ion, and p is an integer of 1 or 2, or a metal compound of a benzilic acid derivative represented by the formula (II):

[Ka 2]

(II)

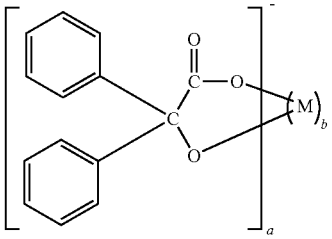

wherein M is boron, a is an integer of 2 or more, and b is an integer of 1 or more;

a colorant; and a resin binder comprising a polyester, wherein the polyester is a polyester obtained by polycondensing an alcohol component comprising a propylene oxide adduct of bisphenol A represented by the formula (III):

[Ka 3]

(III)

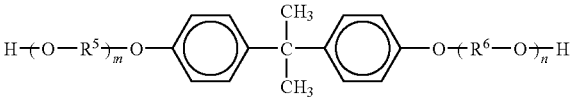

wherein each of $R^5$ and $R^6$ is independently —$CH(CH_3)CH_2$-and/or —$CH_2CH(CH_3)$—, and m and n may be identical or different, wherein m and n are positive numbers, and a carboxylic acid component, wherein an average added number of moles of propylene oxide per one mole of bisphenol A is from 2.4 to 4.0, and wherein an adduct with 2 moles of propylene oxide is contained in an amount of 60% by mole or less, and an adduct with 4 moles of propylene oxide is contained in an amount of 10% by mole or more, of the propylene oxide adduct of bisphenol A, and wherein the propylene oxide adduct of bisphenol A has a content ratio of primary hydroxyl groups of 10% by mole or less of entire hydroxyl groups in the compounds represented by the formula (III).

2. The toner for electrophotography according to claim 1, further comprising a wax having a melting point of from 60° to 95° C.

3. The toner for electrophotography according to claim 1, wherein an adduct with 5 mol of propylene oxide is contained in an amount of from 1 to 10%, of the propylene oxide adduct of bisphenol A.

4. The toner for electrophotography according to claim 1, wherein the propylene oxide adduct of bisphenol A is prepared in the presence of a basic catalyst.

5. The toner for electrophotography according to claim 2, wherein the wax is a paraffin wax or an ester wax.

6. The toner for electrophotography according to claim 1, wherein the polyester is contained in an amount of from 60 to 100% by weight of the resin binder.

7. The toner for electrophotography according to claim 1, wherein the iron-azo complex or the metal compound of a benzilic acid derivative is contained in an amount of from 0.1 to 5 parts by weight, based on 100 parts by weight of the resin binder.

8. The toner for electrophotography according to claim 1, wherein each of n and m independently is from 1 to 18.

9. The toner for electrophotography according to claim 1, wherein each of n and m independently is from 1 to 16.

10. The toner for electrophotography according to claim 1, wherein each of n and m independently is from 1 to 14.

* * * * *